US010988292B2

(12) United States Patent
Giovannini et al.

(10) Patent No.: US 10,988,292 B2
(45) Date of Patent: Apr. 27, 2021

(54) TAMPER-EVIDENT CLOSURES

(71) Applicant: Guala Closures S.p.A., Alessandria (IT)

(72) Inventors: Marco Giovannini, Luxembourg (LU); Luca Viale, Alessandria (IT); James Andrew Oldfield, Scotland (GB)

(73) Assignee: GUALA CLOSURES S.P.A., Alessandria (IT)

( * ) Notice: Subject to any disclaimer, the term of this patent is extended or adjusted under 35 U.S.C. 154(b) by 47 days.

(21) Appl. No.: 16/318,306

(22) PCT Filed: Jul. 11, 2017

(86) PCT No.: PCT/EP2017/067424
§ 371 (c)(1),
(2) Date: Jan. 16, 2019

(87) PCT Pub. No.: WO2018/015219
PCT Pub. Date: Jan. 25, 2018

(65) Prior Publication Data

US 2019/0283944 A1 Sep. 19, 2019

(30) Foreign Application Priority Data

Jul. 19, 2016 (IT) ..... 102016000075495

(51) Int. Cl.
*B65D 55/02* (2006.01)
*B65D 39/00* (2006.01)
*B65D 39/16* (2006.01)

(52) U.S. Cl.
CPC ..... *B65D 55/026* (2013.01); *B65D 39/0052* (2013.01); *B65D 39/16* (2013.01)

(58) Field of Classification Search
CPC ... B65D 55/026; B65D 39/16; B65D 39/0052
See application file for complete search history.

(56) References Cited

U.S. PATENT DOCUMENTS

2004/0129729 A1* 7/2004 Thomson ..... B65D 49/04 222/153.06
2005/0115915 A1* 6/2005 Thomson ..... B65D 49/04 215/252

(Continued)

FOREIGN PATENT DOCUMENTS

EP 1 602 591 A1 12/2005
WO 2012/112127 A1 8/2012

(Continued)

OTHER PUBLICATIONS

International Search Report and Written Opinion dated Sep. 11, 2017, in PCT Application No. PCT/EP2017/067424, 11 pages.

*Primary Examiner* — James N Smalley
(74) *Attorney, Agent, or Firm* — MH2 Technology Law Group LLP

(57) ABSTRACT

A tamper-evident closure includes a cap having a plug, a skirt, and a locking member. The cap and skirt have seats in which a first portion and a second portion of the locking member are arranged. Upon first opening, as the cap moves longitudinally away from the skirt, the lower edge of the cap passes over the first portion longitudinally so that, upon reclosing the tamper-evident closure, the first portion positions in an obstructive manner between the lower edge of the cap and an upper edge of the skirt.

16 Claims, 13 Drawing Sheets

(56) References Cited

U.S. PATENT DOCUMENTS

| | | | | |
|---|---|---|---|---|
| 2009/0289027 | A1* | 11/2009 | Torrent Ortega .... | B65D 55/028<br>215/352 |
| 2011/0259844 | A1* | 10/2011 | Skelton ..... | B65D 55/026<br>215/201 |
| 2014/0183195 | A1* | 7/2014 | McPherson ..... | B65D 55/026<br>220/266 |
| 2016/0060007 | A1* | 3/2016 | McPherson ..... | B65D 41/28<br>220/259.3 |
| 2016/0347520 | A1* | 12/2016 | Torrent Ortega .... | B65D 55/026 |

FOREIGN PATENT DOCUMENTS

| | | | |
|---|---|---|---|
| WO | 2014/016391 | A1 | 1/2014 |
| WO | 2014/124653 | A1 | 8/2014 |

* cited by examiner

TAMPER-EVIDENT CLOSURES

TECHNICAL FIELD

The present invention relates to a tamper evident closure, i.e. a closure comprising devices that can provide evidence of first opening.

In particular, the present application relates to a tamper evident closure with a cap having a plug configured to engage inside the neck of a container.

BACKGROUND OF THE INVENTION

Tamper evident closures with a cap having a plug are known in the art and disclosed for example in WO 2014124653. WO 2014124653 discloses a tamper evident closure with an outer cap and inner part having a plug in which the outer cap moves relative to an inner part upon first opening and means are provided to prevent the outer cap from moving back to the original position once it has risen.

The tamper evident closure disclosed in the above mentioned document necessitates inner and outer parts mutually movable upon first opening to provide a tamper evident feature. In order to guarantee the activation of the tamper evident mechanism, the inner part must remain attached to the neck of the container upon first opening until the outer part has reached the second position. Otherwise, the tamper evident feature would fail upon first opening.

Under certain environmental conditions, the attachment of the inner part to the neck of the container cannot be guaranteed so that, upon first opening, it might happen that the tamper evident mechanism does not activate.

Moreover, in case of sparkling wines, the attachment force of the plug with the neck of the container may be not sufficient to contrast the inner pressure of the container with the consequence that the closure may be ejected when the container is stored.

In view of the above prior art, the object of the present invention is to provide a tamper evident closure not relying upon the attachment of the plug to the container neck for the activation of the tamper evident mechanism upon first opening and with a structure preventing ejection of the closure when the container is stored.

SUMMARY OF THE INVENTION

According to the present invention, this purpose is fulfilled by a tamper evident closure as defined in one or more of the accompanying claims.

BRIEF DESCRIPTION OF THE DRAWINGS

The characteristics and advantages of the present invention will appear from the following detailed description of one practical embodiment, which is given as a non limiting example with reference to the annexed drawings, in which.

DETAILED DESCRIPTION

Figure 1:
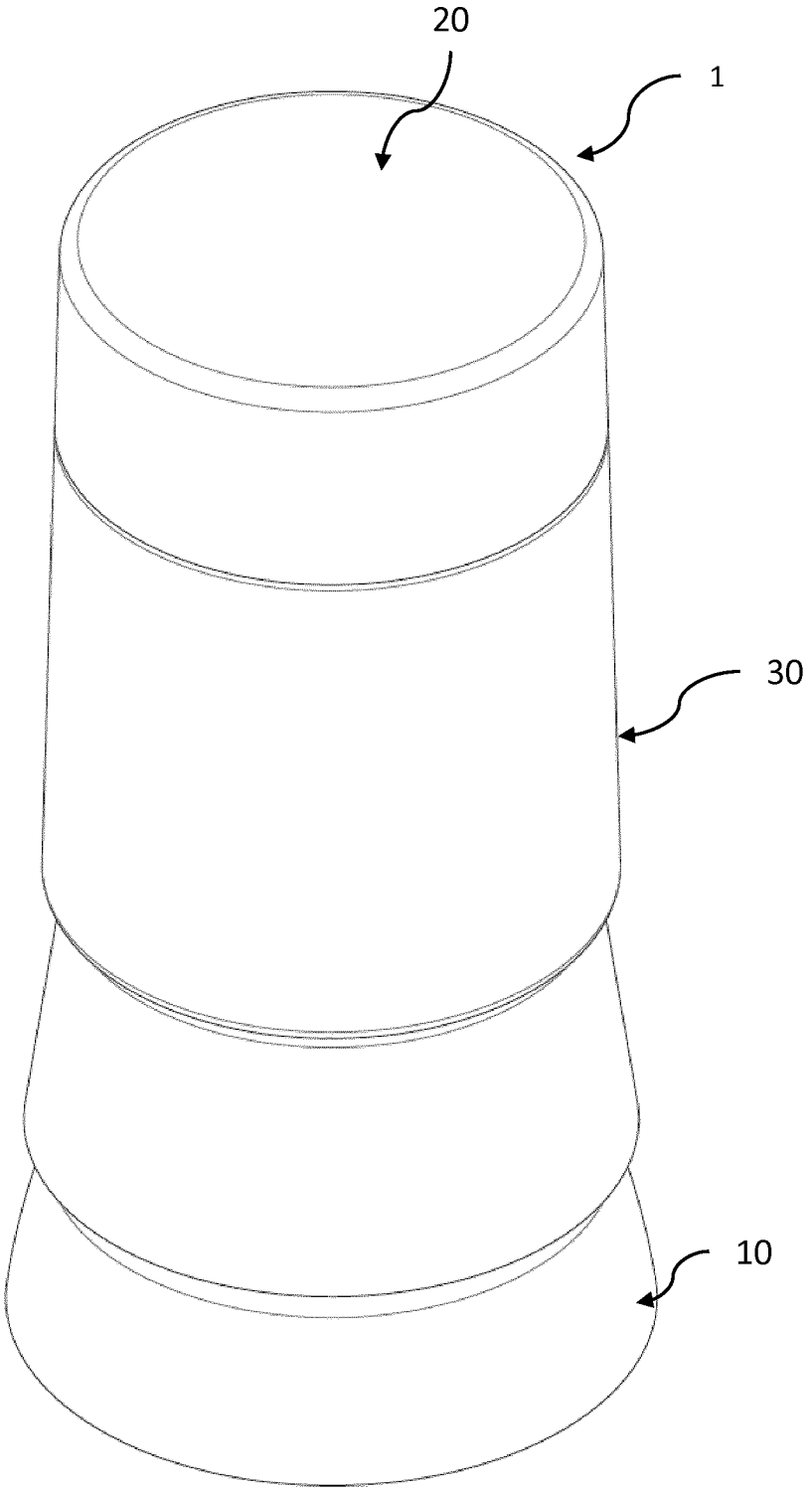
FIG. 1 shows a perspective view of a closure according to a first embodiment of the invention.

Referring to the figures, there is shown a tamper evident closure 1 according to a first embodiment of the invention.

The closure 1 is intended to close the mouth 11 of a container 10, e.g. a bottle, such as a glass bottle, e.g. for spirits.

The container 10 comprises a neck 12 that terminates in the mouth 11.

The closure 1 extends along a longitudinal direction X-X and comprises a cap 20, a skirt 30 and a locking member 40.

Figure 3:
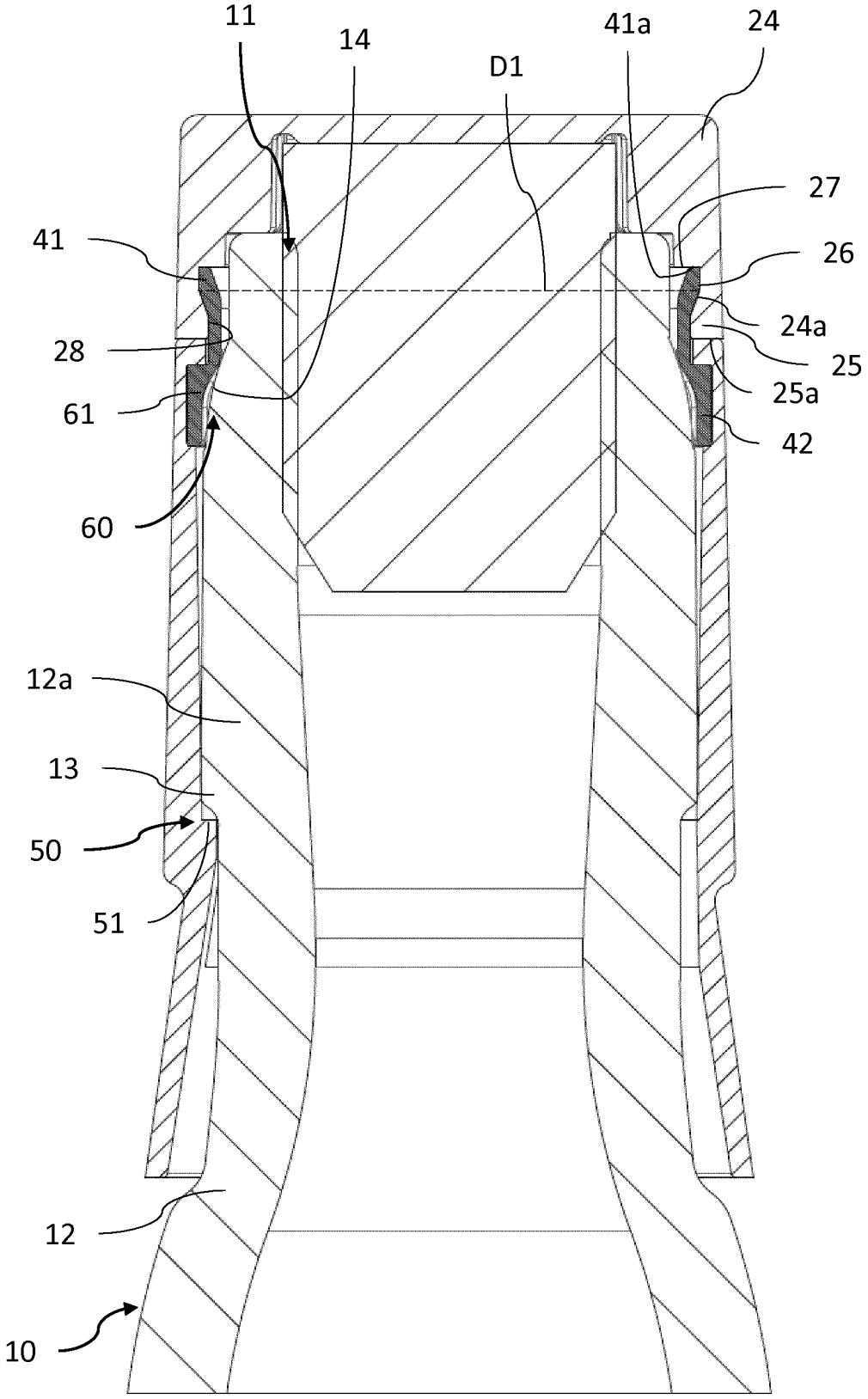
FIG. 3 shows a section view of the closure of FIG. 2, applied to a bottle neck, prior to first opening.
Figure 4:
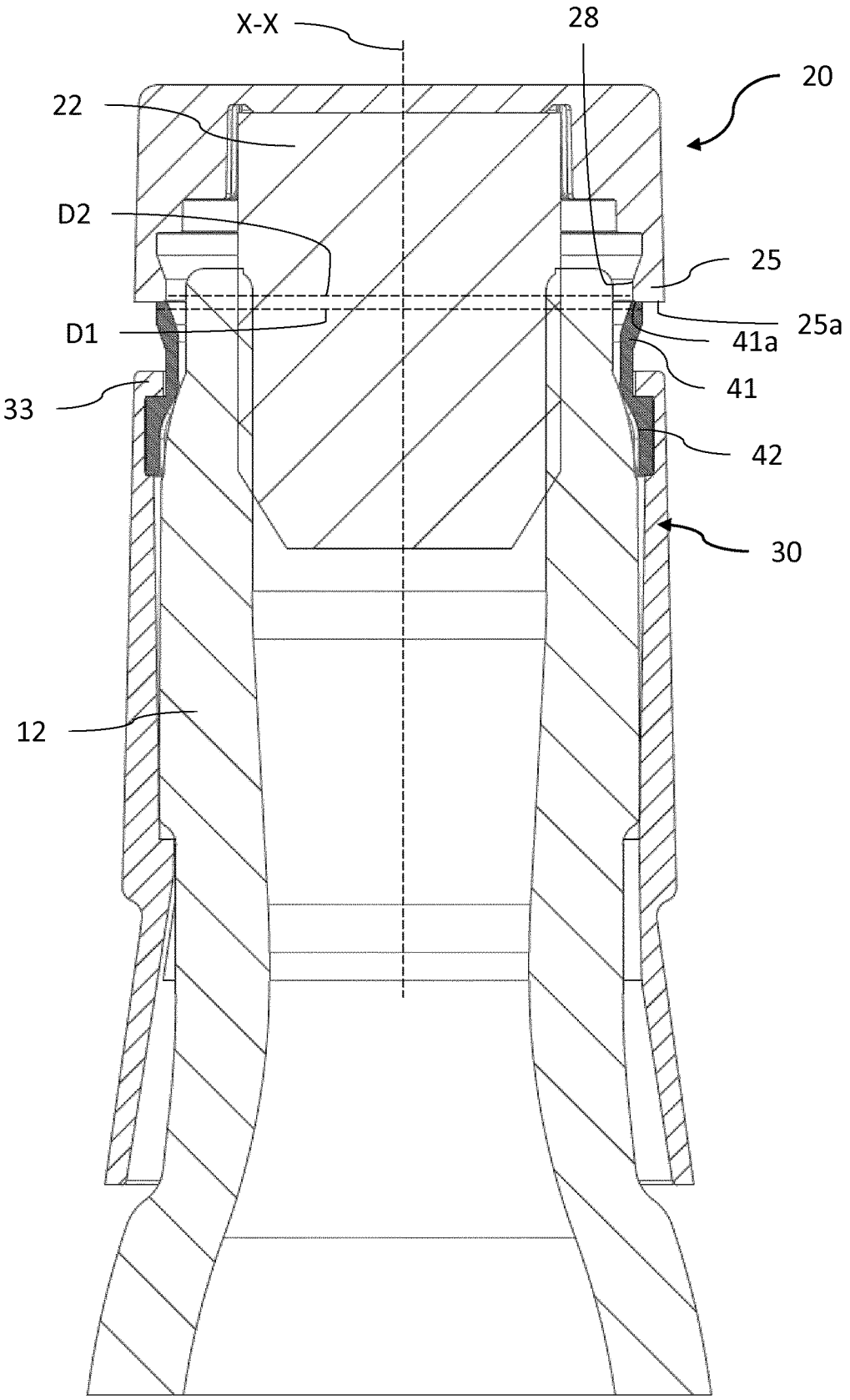
FIG. 4 shows a section view of the closure of FIG. 2, applied to a bottle neck, reclosed after first opening.

The cap 20 is configured to be grasped for opening and closing the container 10 and is movable relative to the skirt 30 along the longitudinal direction X-X from a first position, corresponding to the position prior to first opening (FIG. 3), to a second position (FIG. 4).

The cap 20 comprises a tubular body 21 and a plug 22 that engages removably in a sealing manner inside the neck 12 of the container 10 to close and open the mouth 11.

The plug 22 has a substantially cylindrical shape and is capable of ensuring the desired liquid-tightness in the neck 12 of the container 10.

The plug 22 may be made of cork, synthetic cork or other materials, such as a hollow PE stopper such as the ones for sparkling wine.

In particular, the tubular body 21 comprises a top wall 23 and a first tubular sleeve 24 extending longitudinally between the top wall 23 and a first lower edge 25.

The plug 22 is firmly attached to the tubular body 21.

According to one embodiment the plug 22 is made in one piece with the tubular body 21. Alternatively, members are provided on the plug 22 and/or on the tubular body 21 for firmly attaching the plug 22 to the tubular body 21, such as ribs, locking members, glue and the like.

An overcap (not shown in the figures) may be provided for aesthetic reasons over the tubular body 21.

A capsule (not shown in the figures) made of two parts, one part fitted over the tubular body 21 and one part fitted around the skirt 30 may be provided both for aesthetic reasons and for tamper evident reasons, for example providing a frangible portion connecting the two parts.

The first tubular sleeve 24 has a first inner annular seat 26 formed proximate to the first lower edge 25 on an inner surface 24*a* of the first tubular sleeve 24.

The skirt 30 comprises a second tubular sleeve 31 extending longitudinally between a second lower edge 32 and a second upper edge 33 around an end portion of the neck 12.

The second tubular sleeve 31 has a second inner annular seat 34 formed proximate to the second upper edge 33 on an inner surface 31*a* of the second tubular sleeve 31.

Attaching members are provided for attaching longitudinally and rotationally the skirt 30 to the neck 12.

The attaching members comprise first attaching members 50 for attaching longitudinally the skirt 30 to the neck 12 and second attaching members 60 for attaching rotationally the skirt 30 to the neck 12.

Figure 2:
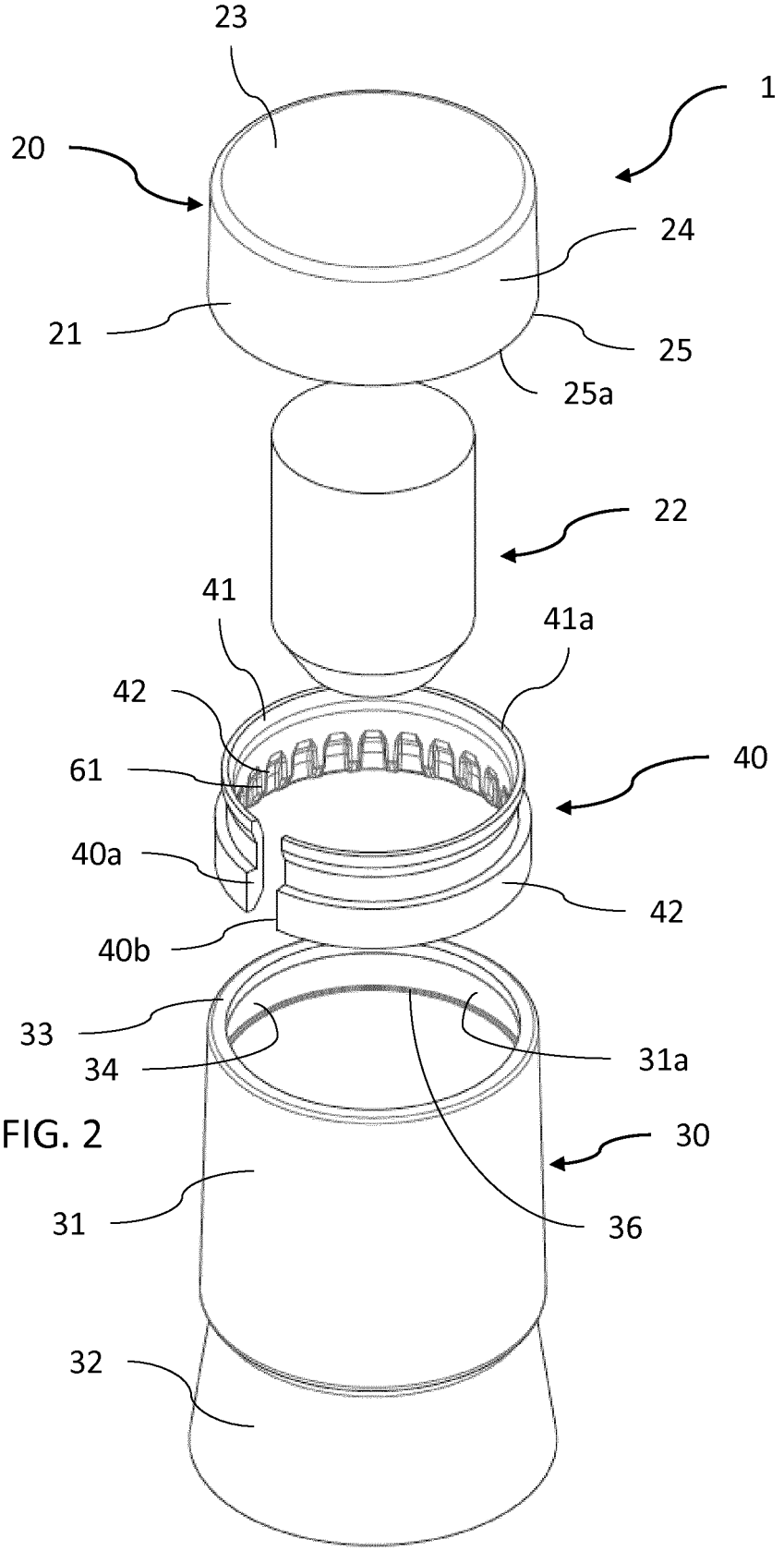
FIG. 2 shows an exploded view of the closure of FIG. 1.

According to the first embodiment of FIGS. 2-4, the first attaching members 50 comprise a plurality of ribs 51 formed on the inner surface 31*a* of the second tubular sleeve 31 and engaged with an annular bead 13 formed on the outer surface of a portion 12*a* of the neck 12 and the second attaching members 60 comprise a plurality of ribs 61 formed on the locking member 40 and configured to engage a plurality of ridges 14 formed on the outer surface of the neck 12.

The locking member 40 comprises a first portion 41 and a second portion 42. The second portion 42 is arranged within the second inner annular seat 34 and is constrained longitudinally to the second tubular sleeve 31.

Before first opening, the first lower edge 25 is, preferably immediately, adjacent to the second upper edge 33 and the first portion 41 of the locking member 40 is arranged within the first inner annular seat 26, therefore longitudinally above the first lower edge 25.

Upon first opening, as the cap 20 moves longitudinally away from the skirt 30 and the neck 12, the first lower edge 25 passes over the first portion 41 longitudinally so that, upon reclosing the closure 1, the first portion 41 positions in an obstructive manner between the first lower edge 25 and the second upper edge 33 and the first lower edge 25 abuts against the first portion 41 to prevent the cap 20 to move back to the first position.

A gap is created between the first lower edge 25 and the second upper edge 33 with the first portion 41 positioned in the gap and visible to a user to provide evidence that the first opening has occurred.

In particular, upon first opening, the first lower edge 25 acts on the first portion 41 of the locking member 40 to allow the first lower edge 25 to pass over the first portion 41 longitudinally.

Preferably, the locking member 40 is an annular member and the first portion 41 has a locking surface 41*a* developing substantially over an entire circumference. More preferably, the locking surface 41*a* is defined by an upper surface of the first portion 41.

In the second position, the locking surface 41*a* of the first portion 41 engages a locking surface 25*a* of the first lower edge 25. Preferably, the locking surface 25*a* of the first lower edge 25 is defined by a lower surface of the first lower edge 25.

Upon first opening, the first portion 41 deforms inwardly in order to let the first lower edge 25 to pass over the first portion 41 longitudinally. As soon as the first lower edge 25 passes over the first portion 41, the locking surface 41*a* of the first portion 41 positions beneath the locking surface 25*a* of the first lower edge 25 and, upon reclosing the closure 1, the locking surface 41*a* engages beneath the locking surface 25*a*.

According to one embodiment, the first inner annular seat 26 is arranged longitudinally between an upper annular abutment surface 27 and a lower annular projecting surface 28. The first portion 41 has a maximum diameter D1 greater than the minimum diameter D2 of the lower annular projecting surface 28.

The second inner annular seat 34 is defined longitudinally between the second upper edge 33 and a lower annular abutment surface 36 and constrains the second portion 42 longitudinally therebetween.

During the manufacturing process, the annular member 40 is positioned with the first portion 41 and the second portion 42 respectively within the first inner annular seat 26 and the second inner annular seat 34.

In the first position, the first portion 41 is arranged within the first inner annular seat 26 and abuts against the lower annular projecting surface 28 so that a longitudinal force generates in a direction opposite to the direction of removal of the cap 20 from the skirt 30. This longitudinal force guarantees the attachment of the cap 20 and the skirt 30 before mounting the closure 1 on the container 10 and, once the closure 1 is mounted on the container 10, it prevents the risk that the cap 20 is ejected as a consequence of the increase of the inner pressure of the container, for example with sparkling wines.

More preferably, in the first position, the first portion 41 is received within the first inner annular seat 26 such that the first inner annular seat 26 keeps the cap 20 attached to the skirt 30 before mounting the closure 1 on the container 10.

It is worthwhile to point out that the above mentioned longitudinal force must guarantee an easy opening of the closure 1 by a user and therefore a comfortable removal of the plug 22 from the neck 12.

According to a preferred embodiment, the annular member 40 is radially deformable.

In the embodiment of the FIGS. 1-7, the annular member 40 is a split ring having two separate ends 40*a*, 40*b*.

Figure 5:
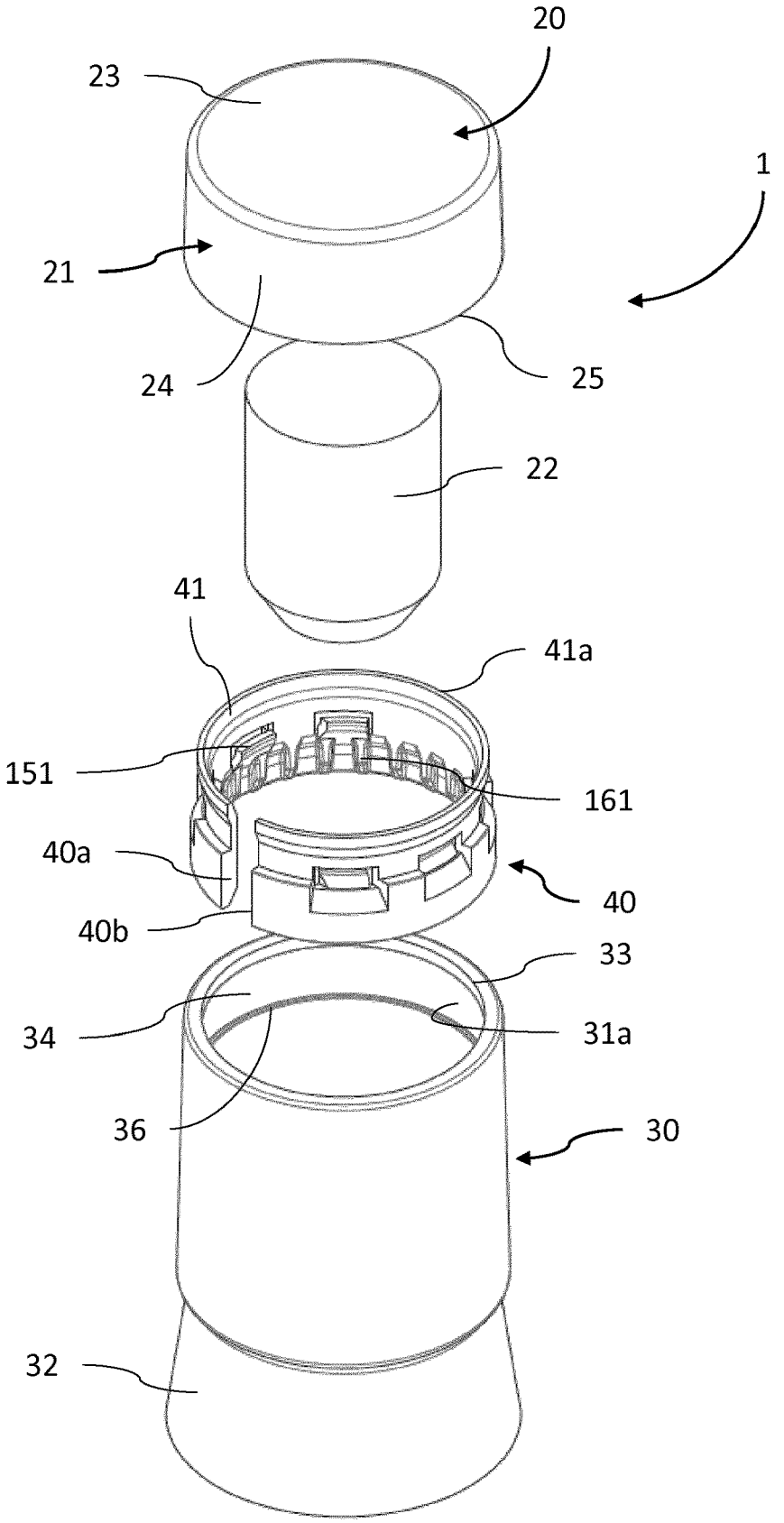
FIG. 5 shows an exploded view of a closure according to a second embodiment of the invention.
Figure 6:
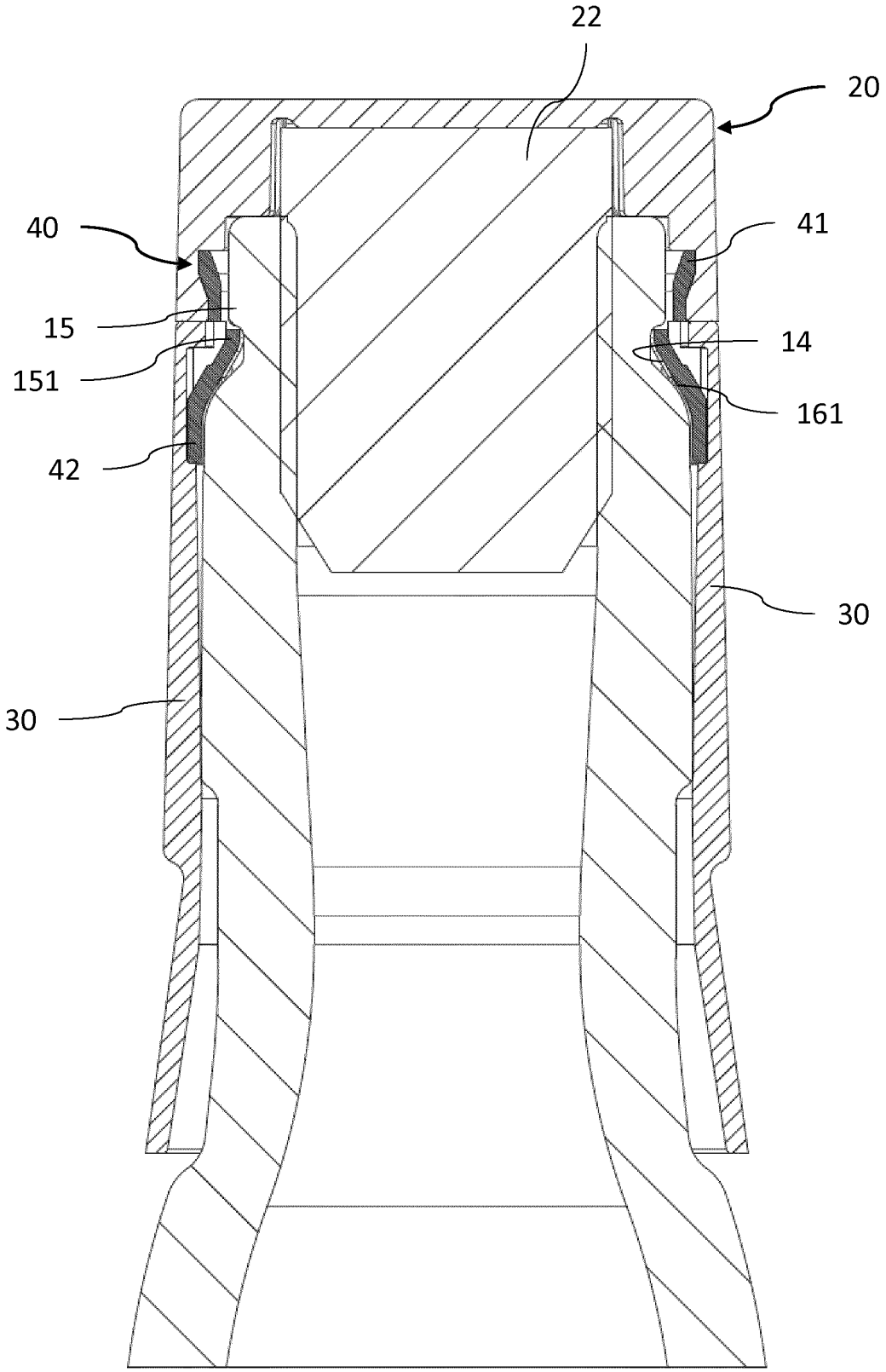
FIG. 6 shows a section view of the closure of FIG. 5, applied to a bottle neck, prior to first opening.
Figure 7:
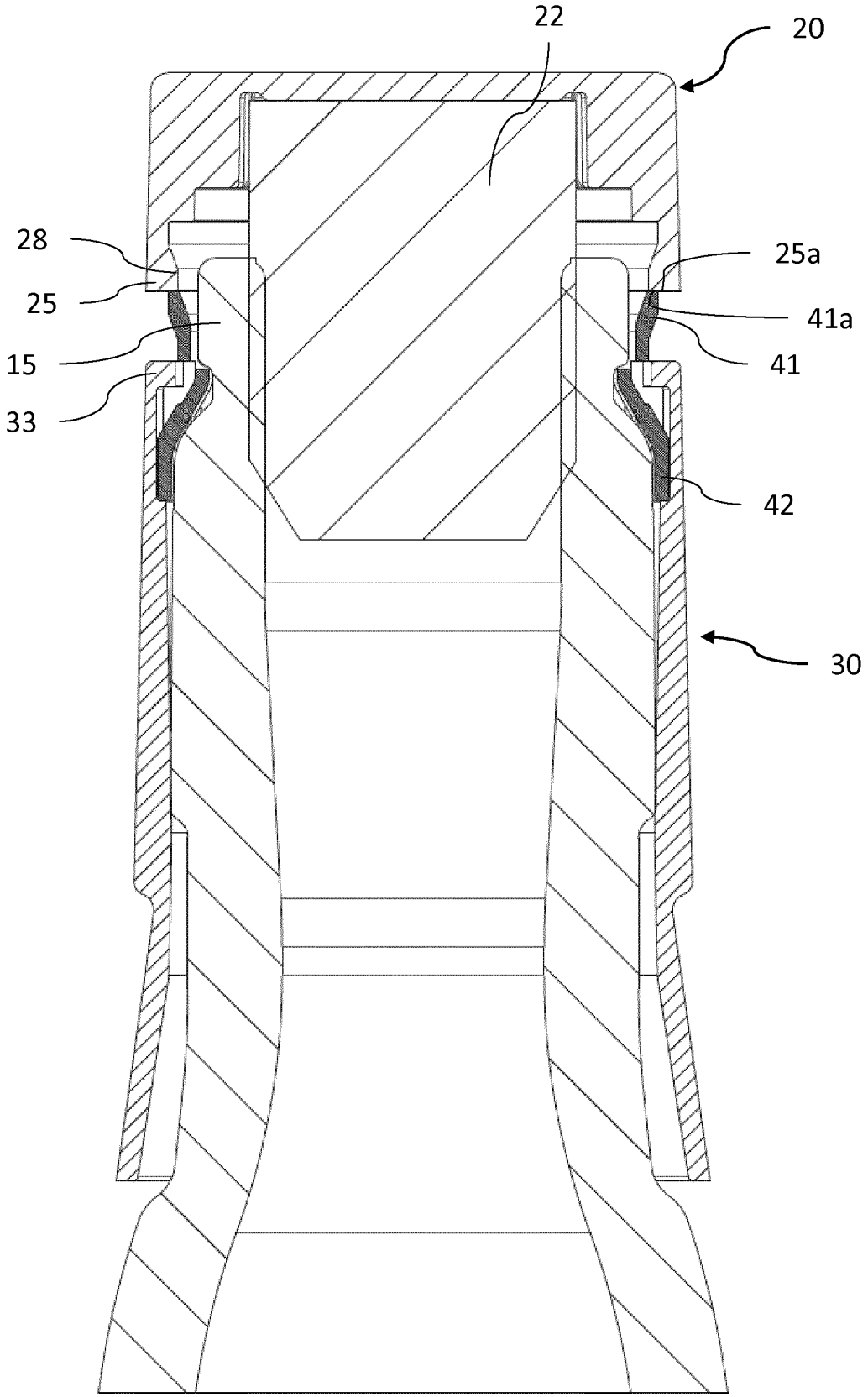
FIG. 7 shows a section view of the closure of FIG. 5, applied to a bottle neck, reclosed after first opening.

The second embodiment of FIGS. 5-7 will be now described with the assumption that the differences with the first embodiment will be only mentioned, whereby all that is not expressly described as different may be intended to be provided in a similar or identical manner.

With this second embodiment, the first attaching members 50 comprise a plurality of projections 151 formed on the locking member 40 and engaged with an annular collar 15 formed on the outer surface of the neck 12 proximate to the end of portion of the neck 12 and the second attaching members 60 comprise a plurality of ribs 161 formed on the locking member 40 and configured to engage the plurality of ridges 14 formed on the outer surface of the neck 12.

Figure 8:
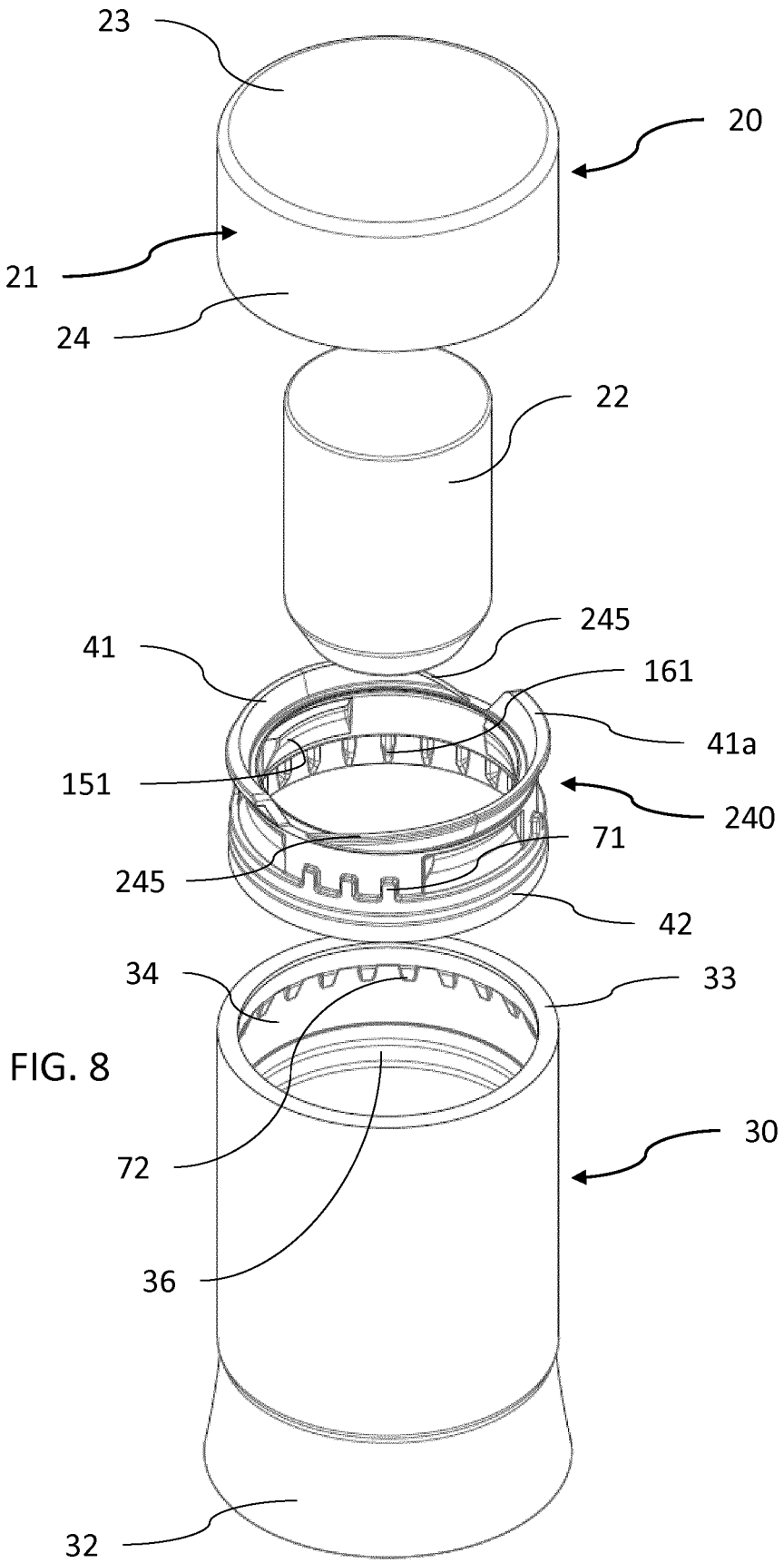
FIG. 8 shows an exploded view of a closure according to a third embodiment of the invention.
Figure 9:
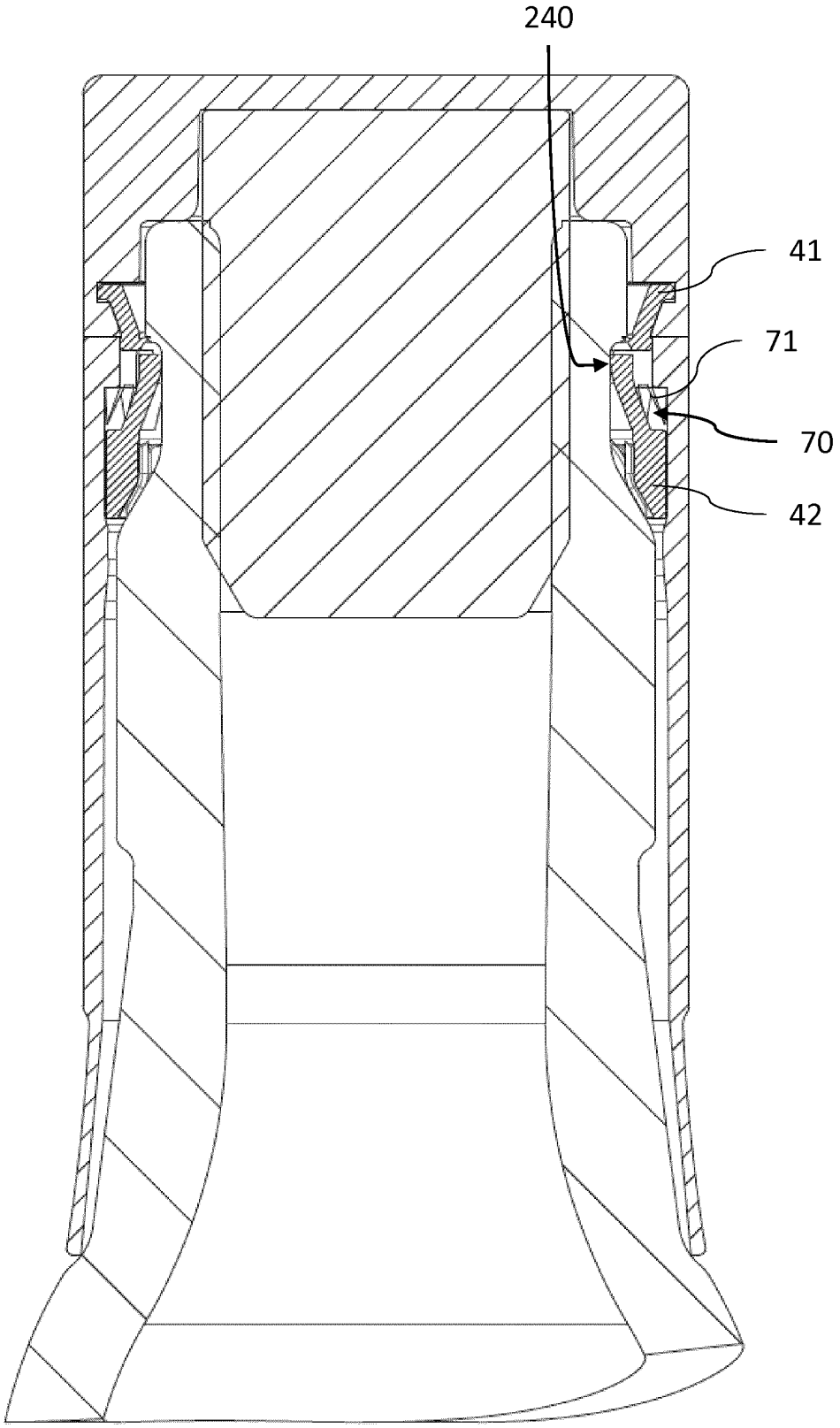
FIG. 9 shows a section view of the closure of FIG. 8, applied to a bottle neck, prior to first opening.
Figure 10:
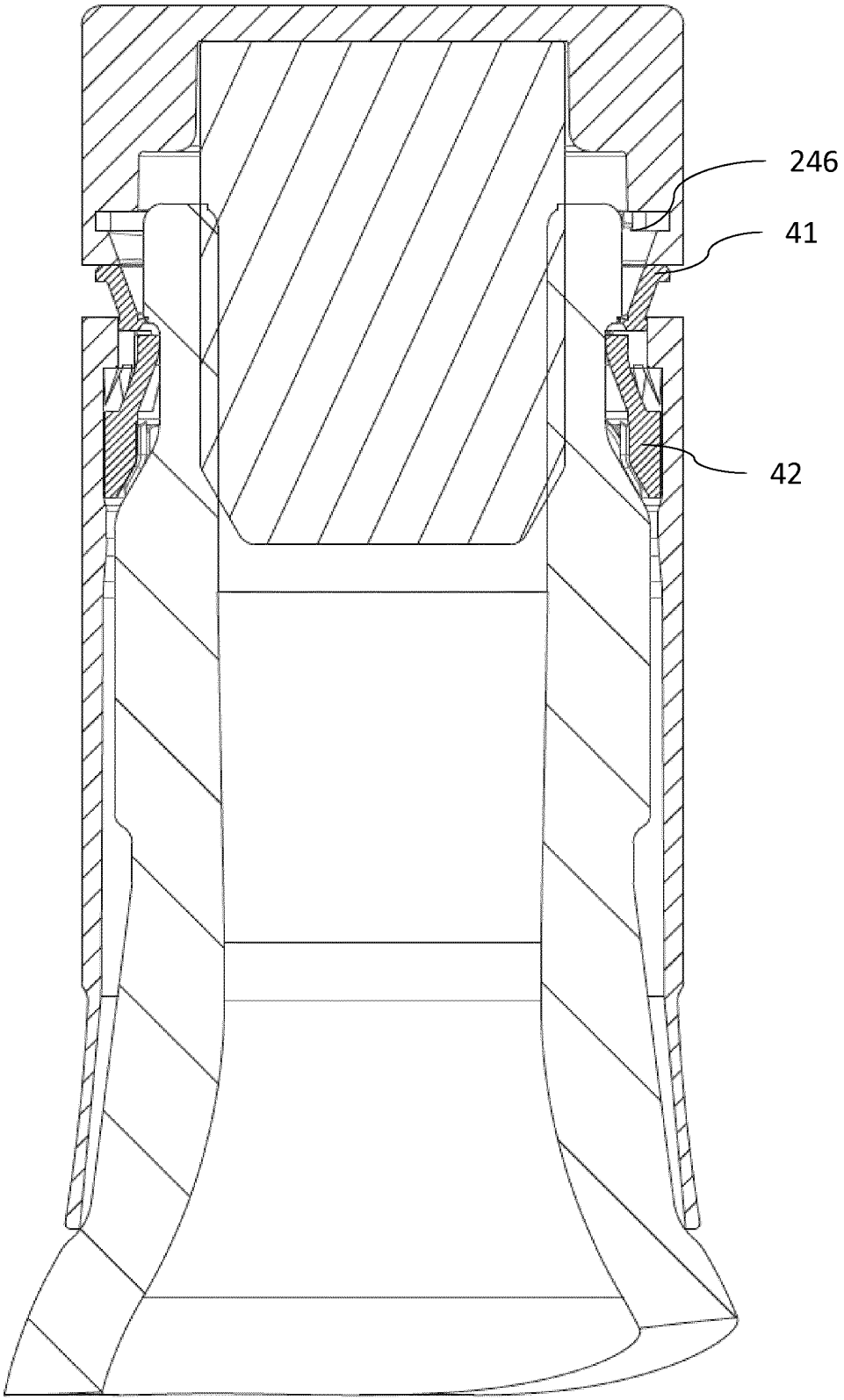
FIG. 10 shows a section view of the closure of FIG. 8, applied to a bottle neck, reclosed after first opening.

The third embodiment of FIGS. 8-10 will be now described with the assumption that the differences with the previous embodiments will be only mentioned, whereby all that is not expressly described as different may be intended to be provided in a similar or identical manner.

With this third embodiment, the locking member 240 is a closed ring. This increases the strength of the closure 1 during handling and mounting of the same on the container 1.

Preferably, anti-rotation members 70 are provided for constraining rotationally the skirt 30 to the locking member 240 and the locking member 240 comprises first cam portions 245 and the cap 20 comprises second cam portions 246.

Upon first opening, as the cap 20 is rotated relative to the skirt 30, the first cam portions 245 cooperate with the second cam portions 246 to move the cap 20 longitudinally away from the skirt 30. Therefore, the first and second cam portions 245, 246 help to move the cap 20 longitudinally away from the skirt 30.

According to one embodiment, the anti-rotation members 70 comprises first lugs 71 formed on an outer surface of the second portion 42 and cooperating with second lugs 72 formed on the inner surface of the second tubular sleeve 31 to constrain rotationally the second portion 42 of the locking member 240 to the second tubular sleeve 31 of the skirt 30.

It is worthwhile to note that the anti-rotation members 70 and the first and second cam portions 245, 246 may be provided also on the closure according to the first embodiment of FIGS. 1-4 and second embodiment of FIGS. 5-7.

Figure 11:
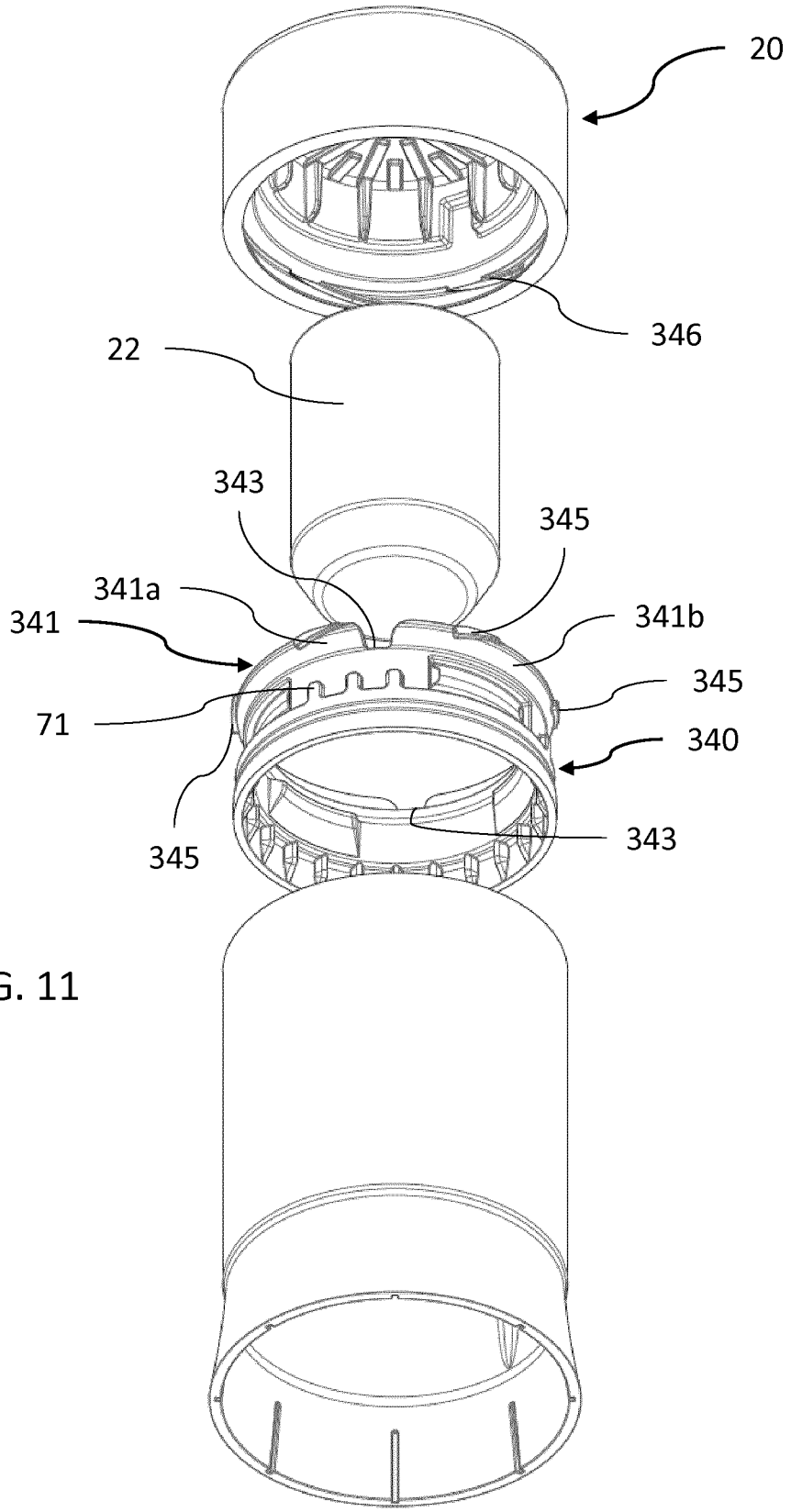
FIG. 11 shows an exploded view of a closure according to a fourth embodiment of the invention.
Figure 12:
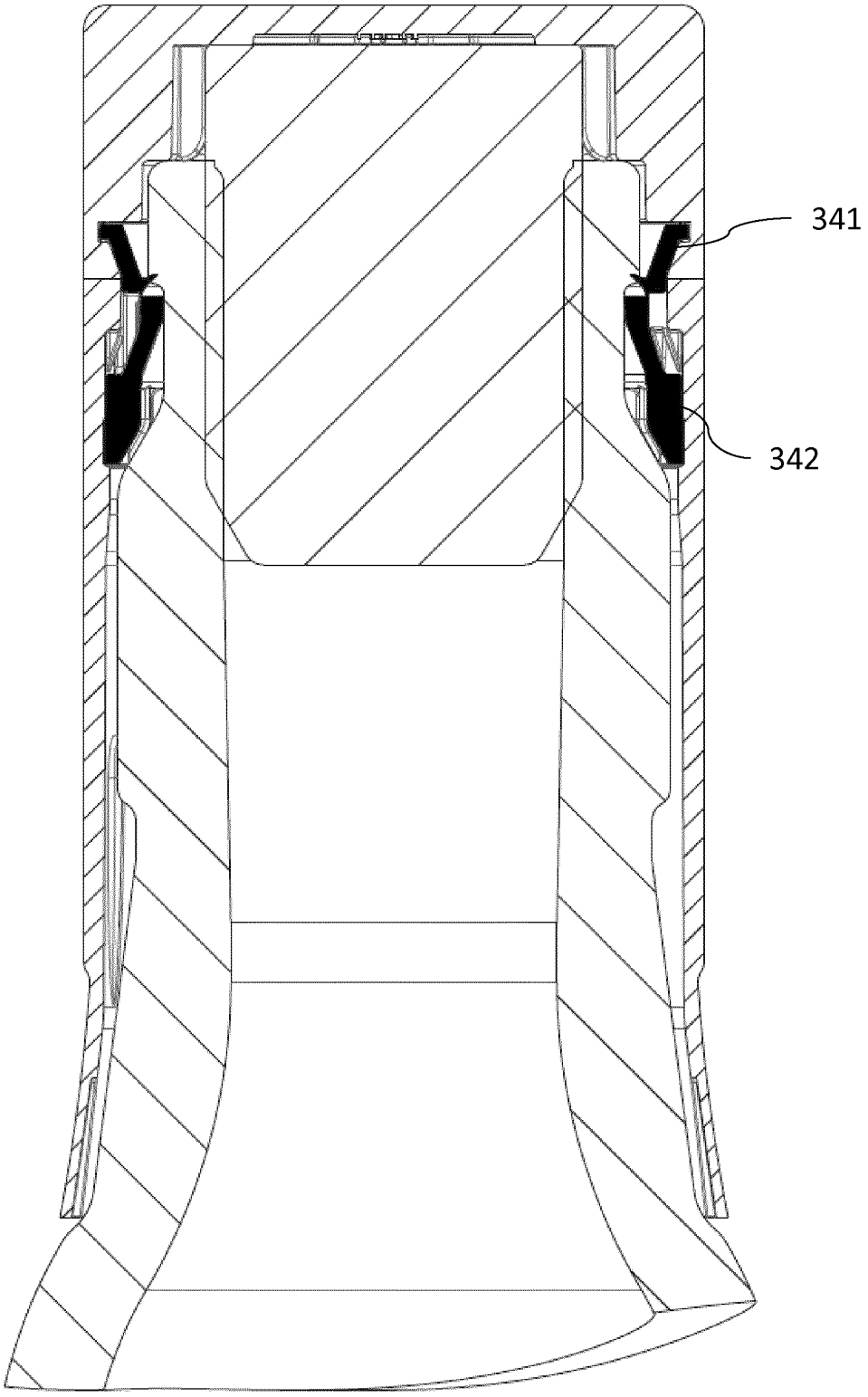
FIG. 12 shows a section view of the closure of FIG. 11, applied to a bottle neck, prior to first opening.
Figure 13:
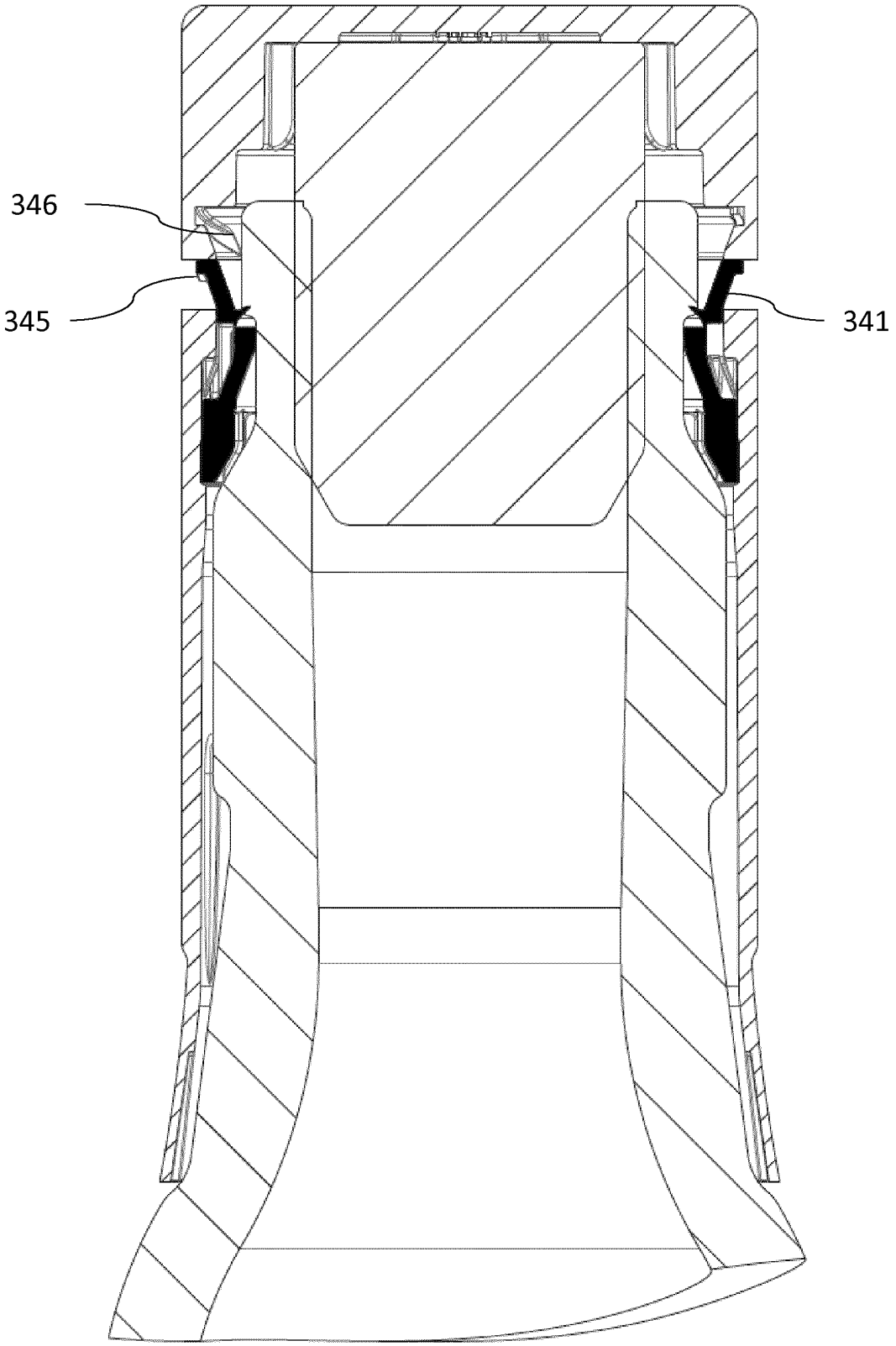
FIG. 13 shows a section view of the closure of FIG. 11, applied to a bottle neck, reclosed after first opening.

The fourth embodiment of FIGS. 11-13 will be now described with the assumption that the differences with the previous embodiments will be only mentioned, whereby all that is not expressly described as different may be intended to be provided in a similar or identical manner.

With this fourth embodiment, the locking member 340 is a closed ring and at least one slot, in the example two slots 343, are formed in the first portion 341. Each slot 343 extends longitudinally towards the second portion 342 and circumferentially for a portion of the locking member 340. The two slots 343 separates the first portion 341 into two parts 341*a* and 341*b* thereby increasing the flexibility of the two parts 341*a*, 341*b* and overall of the first portion 341. Thanks to the slots 343, upon first opening, as the first lower edge 25 acts on the first portion 341 to allow the first lower edge 25 to pass over the first portion 341 longitudinally, the two parts 341*a*, 341*b* of the first portion 341 deforms inwardly much easier than with the third embodiment.

Preferably, the locking member 340 comprises first threaded portions 345 and the cap 20 comprises second threaded portions 346.

Upon first opening, as the cap 20 is rotated relative to the skirt 30, the first threaded portions 345 cooperate with the second threaded portions 346 to move the cap 20 longitudinally away from the skirt 30. Therefore, the first and second threaded portions 345, 346 help to move the cap 20 longitudinally away from the skirt 30 as the first and second cam portions 245, 246 of the third embodiment.

The invention claimed is:

1. A tamper-evident closure to be mounted on a neck of a container comprising the neck that terminates in a mouth, for closing the mouth when the tamper-evident closure is mounted on the neck, said tamper-evident closure extending along a longitudinal direction and comprising:

a cap having a plug configured to engage removably inside the neck of the container to close and open the mouth of the container, a skirt configured to be arranged around the upper end portion of the neck, attaching members for attaching longitudinally and rotationally the skirt to the neck, and a locking member, wherein:

said cap is configured to be grasped for opening and closing the container and is movable relative to said skirt from a first position, corresponding to the position prior to first opening, to a second position, said cap comprises a top wall and a first tubular sleeve extending longitudinally between said top wall and a first lower edge, said skirt comprises a second tubular sleeve extending longitudinally between a second lower edge and a second upper edge, said first tubular sleeve has a first inner annular seat formed proximate to said first lower edge, said second tubular sleeve has a second inner annular seat formed proximate to said second upper edge, said locking member comprises a first portion and a second portion, said second portion is arranged within said second inner annular seat and is constrained at least longitudinally to said second tubular sleeve, before first opening, said first lower edge is adjacent to said second upper edge and said first portion is arranged within said first annular seat longitudinally above said first lower edge, and upon first opening, as the cap moves longitudinally away from the skirt and the neck, the first lower edge passes over the first portion longitudinally so that, upon reclosing the tamper-evident closure, the first portion positions in an obstructive manner between the first lower edge and the second upper edge and the first lower edge abuts against the first portion to prevent the cap to move back to the first position.

2. The tamper-evident closure according to claim 1, wherein upon first opening, the first lower edge acts on the first portion of the locking member to allow the first lower edge to pass over the first portion longitudinally.

3. The tamper-evident closure according to claim 1, wherein:

the locking member is an annular member and the first portion has a locking surface developing substantially over an entire circumference, upon first opening, the first portion deforms inwardly to let the first lower edge to pass over the first portion longitudinally, and in the second position, the locking surface of the first portion positions beneath a locking surface of the first lower edge and, upon reclosing the container, the locking surface of the first portion engages beneath the locking surface of the first lower edge.

4. The tamper-evident closure according to claim 1, wherein:

the first inner annular seat is arranged longitudinally between an upper annular abutment surface and a lower annular projecting surface, and the first portion has a maximum diameter greater than the minimum diameter of the lower annular projecting surface so that, upon first opening, the lower annular projection surface acts on the first portion to let the first lower edge to pass over the first portion longitudinally.

5. The tamper-evident closure according to claim 4, wherein:

in the first position, the first portion is arranged within the first inner annular seat and abuts against the lower annular projecting surface so that a longitudinal force generates in a direction opposite to the direction of removal of the cap from the skirt to guarantee the attachment of the cap to the skirt before mounting the tamper-evident closure on the container.

6. The tamper-evident closure according to claim 4, wherein:

in the first position, the first portion is received within the first inner annular seat such that the first inner annular seat keeps the cap attached to the skirt before mounting the tamper-evident closure on the container.

7. The tamper-evident closure according to claim 1, wherein the locking member is a split ring having two separate ends.

8. The tamper-evident closure according to claim 1, wherein the locking member is a closed ring.

9. The tamper-evident closure according to claim 8, wherein:

at least one slot is formed in the first portion of the locking member, said at least one slot separates the first portion into two parts, and upon first opening, as the first lower edge acts on the first portion to allow the first lower edge to pass over the first portion longitudinally, each of the two parts of the first portion deforms inwardly.

10. The tamper-evident closure according to claim 1, wherein:

anti-rotation members are provided for constraining rotationally the skirt to the locking member, the locking member comprises first cam portions and the cap comprises second cam portions, and upon first opening, as the cap is rotated relative to the skirt, the first cam portions cooperate with the second cam portions to move the cap longitudinally away from the skirt.

11. The tamper-evident closure according to claim 1, wherein:

anti-rotation members are provided for constraining rotationally the skirt to the locking member, the locking member comprises first threaded portions and the cap comprises second threaded portions, and upon first opening, as the cap is rotated relative to the skirt, the first threaded portions cooperate with the second threaded portions to move the cap longitudinally away from the skirt.

12. The tamper-evident closure according to claim 10, wherein:

said anti-rotation members comprise first lugs formed on an outer surface of the second portion and cooperating with second lugs formed on the inner surface of the second tubular sleeve to constrain rotationally the second portion to the second tubular sleeve.

13. The tamper-evident closure according to claim 11, wherein:

said anti-rotation members comprise first lugs formed on an outer surface of the second portion and cooperating with second lugs formed on the inner surface of the second tubular sleeve to constrain rotationally the second portion to the second tubular sleeve.

14. The tamper-evident closure according to claim 1, wherein said attaching members comprise first attaching members for attaching longitudinally said skirt to the neck and second attaching members for attaching rotationally said skirt to the neck.

15. The tamper-evident closure according to claim 14, wherein said first attaching members comprise a plurality of ribs formed on the inner surface of the second tubular sleeve and engaged with an annular bead formed on the outer surface of the neck, and the second attaching members comprise a plurality of ribs formed on the locking member and configured to engage a plurality of ridges formed on the outer surface of the neck.

16. The tamper-evident closure according to claim 15, wherein said first attaching members comprise a plurality of projections formed on the locking member and engaged with an annular collar formed on the outer surface of the neck proximate to the end of portion of the neck, and the second attaching members comprise a plurality of ribs formed on the locking member and configured to engage a plurality of ridges formed on the outer surface of the neck.

* * * * *